US005640984A

United States Patent [19]

Dubunsky

[11] Patent Number: 5,640,984

[45] Date of Patent: Jun. 24, 1997

[54] SPECIAL FOLD-UP UMBRELLA HAVING RIB AND FRAME DESIGN FOR EASIER OPENING AND CLOSING OF UMBRELLA, AND TWO CANOPIES DESIGNED TO STABILIZE THE RIBS AND VENT THE AIR

[76] Inventor: Emanuel Dubunsky, 3 Cross Ridge Rd., Chappaqua, N.Y. 10514

[21] Appl. No.: 526,547

[22] Filed: Sep. 12, 1995

[51] Int. Cl.[6] ..... A45B 25/18

[52] U.S. Cl. ..... 135/33.2; 135/33.7; 135/25.31; 135/29; 135/15.1; 135/22

[58] Field of Search ..... 135/98, 15.1, 19.5, 135/20.1, 22, 20.3, 25.1, 25.31, 25.32, 29, 31, 33.2, 33.5, 33.7

[56] References Cited

U.S. PATENT DOCUMENTS

| | | | |
|---|---|---|---|
| 212,457 | 2/1879 | Girbardt | 135/33.7 |
| 312,446 | 2/1885 | Drake | 135/33.7 X |
| 808,863 | 1/1906 | McGuire | 135/22 |
| 1,652,667 | 12/1927 | Greenberg | 135/33.2 X |
| 1,723,044 | 8/1929 | Khalil | 135/33.7 |
| 2,017,753 | 9/1935 | Goldman | 135/33.5 |
| 2,213,058 | 8/1940 | Sweet et al. | 135/33.2 X |
| 3,429,320 | 2/1969 | Edelkind | 135/33.5 X |
| 5,305,770 | 4/1994 | DeMarco | 135/33.2 X |

*Primary Examiner*—Wynn E. Wood
*Attorney, Agent, or Firm*—Philip Young, Esq.

[57] ABSTRACT

A garden umbrella employing an upper canopy extending from the top of the umbrella pole to the middle of long canopy ribs, and a lower outer canopy extending in a ring around the outer part of the umbrella and having long sleeves sewn across the canopy in a radial pattern for receiving a canopy rib in each sleeve. The canopy ribs are pivotally connected to a runner notch, while the other ends of the canopy ribs are received in the canopy sleeves. Stretcher ribs are pivotally connected between each canopy rib and a top ribholder secured at the top of the umbrella pole. The rib and runner notch configuration, together with the outer canopy, permit very easy opening and closing of the umbrella by movement of the runner notch between its upper, open umbrella position and its lower, closed umbrella position. The lower canopy comprises panels sewn together along the bottom of each rib such that a wind vent space is formed with the upper canopy which extends to the top of each rib. The lower canopy panels also include metal rods sewn therein at selected locations for maintaining the shape and handling of the canopy. Counterweights are provided in the canopy ribs to facilitate opening of the umbrella. Also, a strap is designed to wrap the lower canopy when the umbrella is closed.

18 Claims, 4 Drawing Sheets

SPECIAL FOLD-UP UMBRELLA HAVING RIB AND FRAME DESIGN FOR EASIER OPENING AND CLOSING OF UMBRELLA, AND TWO CANOPIES DESIGNED TO STABILIZE THE RIBS AND VENT THE AIR

BACKGROUND OF THE INVENTION

1. Field of The Invention

The present invention relates to umbrellas and, more particularly, to umbrellas of the generally large size used outdoors in the patio and garden and commonly referred to as "garden umbrellas".

2. Background Art

The conventional umbrellas and, more particularly, the larger sized patio and garden umbrellas generally are made with rib support system having canopy ribs attached to the umbrella canopy along the entire rib length extending from the top of the umbrella to the lower end of the canopy. Stretcher ribs are connected between the middle portion of the each canopy rib and a runner notch which slides vertically up and down the umbrella pole to extend and retract the canopy ribs to respectively open and close the umbrella. In such conventional umbrella, either a pulley cord or a hand crank system is connected to effect the vertical movement of the ribholder runner notch between its open and closed umbrella positions. Due to the basic stretcher rib, canopy rib and runner notch configuration, there is a considerable force required to open and close the umbrella by moving the ribholder to pivot the stretcher rib and canopy ribs between the fully open and fully closed umbrella positions. This large force requirement, as well as the large travel distance required of the ribholder runner, particularly for the large patio umbrellas, becomes cumbersome for the average umbrella user, particularly in the absence of hand crank pulley systems.

Also, in such conventional umbrellas, the canopy extends its entire length along full length of the canopy ribs and is secured to the ribs. One problem with such umbrella is that the opening of the umbrella requires a significant force to cause the stretcher ribs to push the canopy ribs and the canopy into their stretched, fully open position. Another disadvantage of such umbrellas is that the wind can lift the underside of the full canopy and force it into an inside out configuration, often destroying the canopy and the rib support. With these conventional umbrellas, the size of the umbrella is usually limited to a nine foot diameter in order to avoid the canopy tips from hitting or "sweeping" the table top when closing the umbrella.

Another canopy rib frame configuration comprises canopy ribs pivotally connected to a ribholder runner notch at one rib end while the other rib ends are attached to be received in the ends of the canopy. Here, the canopy ribs extend upward from the ribholder when closing the umbrella. This causes the canopy to extend downward from the top of the umbrella, and fold upward to the outer rim of the canopy at the rib outer ends. This fold in the canopy may act as a collector of water from rain occuring when the umbrella is closed, which water is undesirable since it may add considerable weight to the umbrella and will pour out when the umbrella is opened. This type of umbrella, with its folded canopy, also may have its canopy panels loosely flapping so that rain is permitted to enter the canopy panels when in the closed position. These loose panels also make it difficult to wrap the canopy panels in order to allow a protective cover to slip over the umbrella.

SUMMARY OF THE INVENTION

It is an object of the present invention to provide an umbrella which is easier to open and close than conventional umbrellas. It is another object to provide an umbrella requiring minimum force on the ribholder runner notch for opening and closing the umbrella. It is another object to provide an umbrella designed with means to control the ease of opening and closing the same. It is another object to provide a rib and canopy design that stabilizes the umbrella against the undesirable effects of wind. It is another object to provide an umbrella of the type wherein the canopy is pivoted upward as the umbrella is closed, yet the closed umbrella does not collect rainwater. It is another object to provide an umbrella wherein the canopy panels are maintained in a taut condition when the umbrella is open, with means for tightly confining such panel when the umbrella is closed.

These, and other objects, are achieved by the present invention which provides a garden umbrella employing an upper canopy extending from the top of the umbrella pole to the middle of the canopy ribs, and a lower outer canopy extending in a ring around around the outer circumferential area of the umbrella and having long sleeves sewn across the lower canopy in a radial pattern for receiving a canopy rib in each sleeve. The canopy ribs are pivotally connected to a ribholder runner notch adapted to slide up and down the umbrella pole for opening and closing the umbrella, while the other ends of the canopy ribs are received in the sleeves of the lower canopy. A stretcher rib is pivotally connected between a middle portion of each canopy rib and a top ribholder secured at the top of the umbrella pole. The canopy rib, stretcher rib and runner notch arrangement, together with the lower outer canopy, permit very easy opening and closing of the umbrella by movement of the runner notch between its upper, open umbrella position and its lower, closed umbrella position. The lower canopy comprises panels sewn together along the bottom of each canopy rib such that a wind vent space is formed with the upper canopy which extends down to the top of each rib. The lower canopy panels also include metal rods sewn therein at selected locations for maintaining the canopy shape and to assist in handling of the canopy. Counterweights are provided in the frame ribs to facilitate opening of the umbrella. Also, a strap is designed to wrap the lower canopy when the umbrella is closed whereby the umbrella is fully and tightly secured and the canopy panels are prevented from flapping.

BRIEF DESCRIPTION OF THE DRAWINGS

Figure 1:
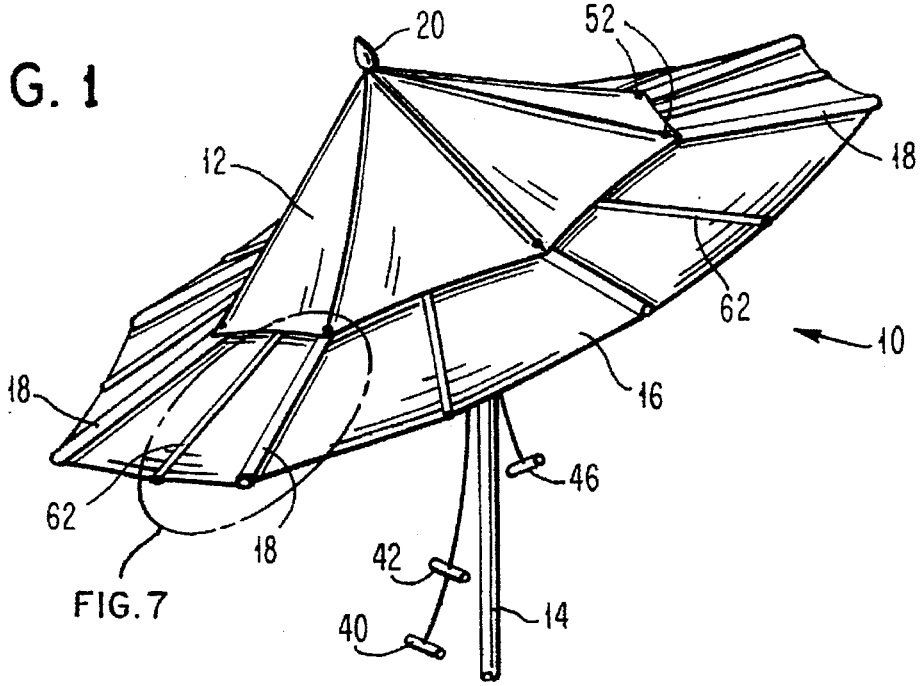
FIG. 1 is a perspective view of an overall umbrella taken from the top to side of the umbrella, incorporating the two piece canopy, illustrative of the present invention.
Figure 2:
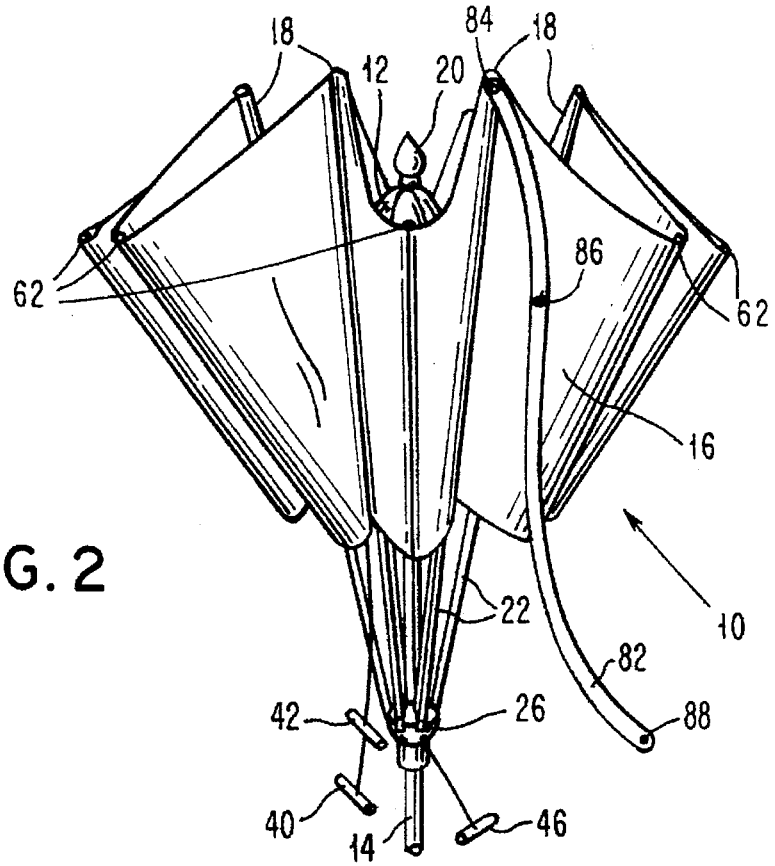
FIG. 2 is a side view of the umbrella in the almost closed position, showing part of the canopy ribs extending up from the ribholder runner notch, and the lower canopy with the strap for wrapping the canopy panels tightly together.
Figure 3:
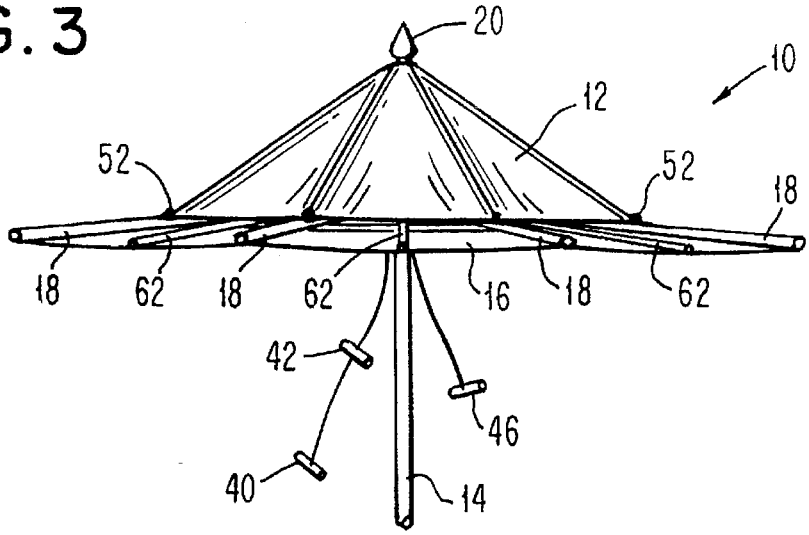
FIG. 3 is a side view of the umbrella in fully open position, showing the upper canopy separated from the lower canopy.
Figure 4:
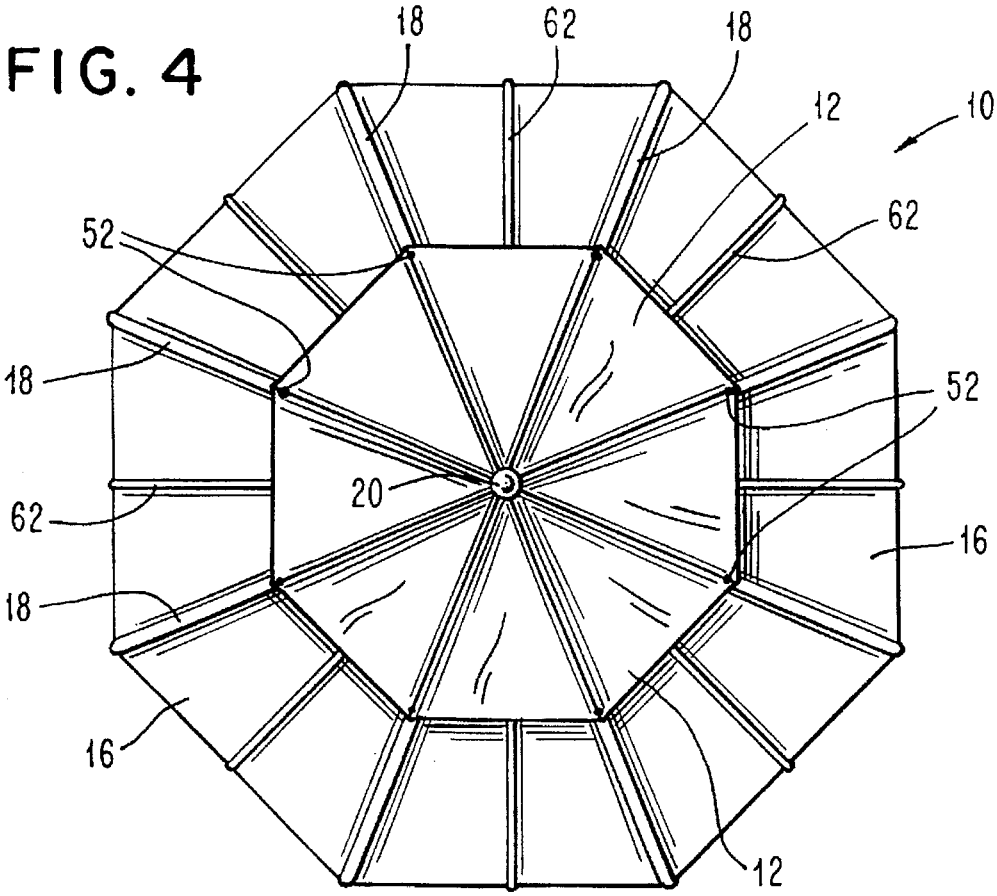
FIG. 4 is a top view of the umbrella, showing the upper canopy and the lower canopy in open position, with the arrangement of the canopy rib sleeves and the metal rod sleeves sewn into the lower canopy.
Figure 5:
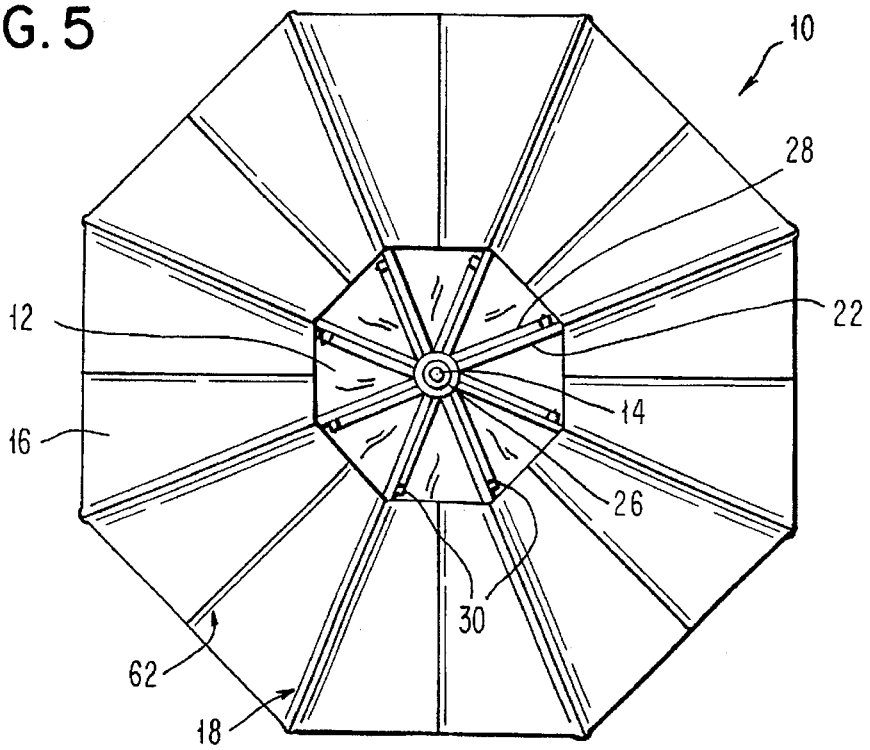
FIG. 5 is a bottom view of the umbrella in open position, including the canopy ribs and sleeves therefor.

Referring to FIGS. 1, and 2, there are respectively shown perspective and side views of a garden umbrella 10 having an upper canopy 12 extending from the top portion 20 of the umbrella pole 14 down to a point, at a screw 52, above a lower canopy 16. For garden umbrellas, the pole 14 typically extends through a table top, not shown, and is supported at its lower end by a heavy base or footing member, not shown. FIGS. 1 and 2 show the umbrella, respectively, in the open and closed positions. FIG. 3 shows the umbrella in open position, while the upper canopy 12 and the lower canopy 16 are shown, respectively, in top and bottom views in FIGS. 4 and 5.

Figure 6:
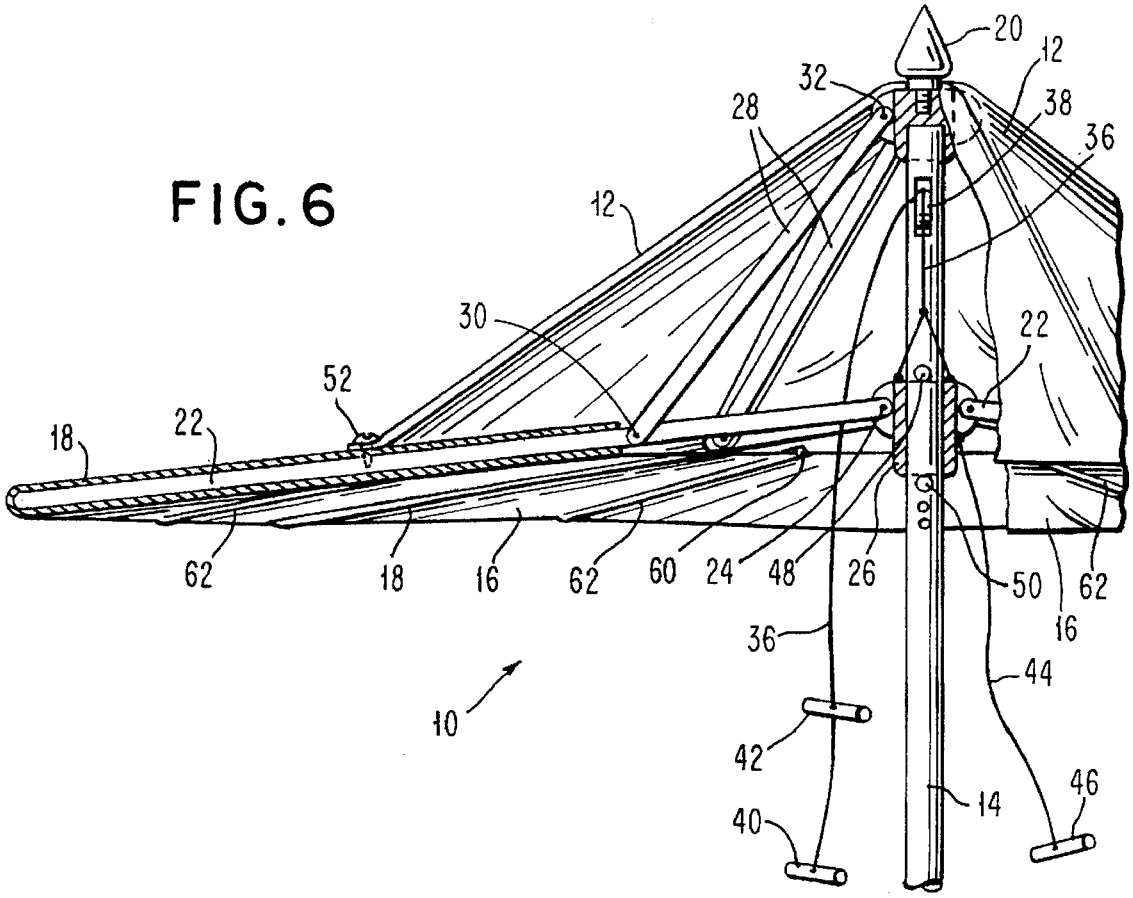
FIG. 6 is the cutaway sect view of the umbrella, with the special canopy rib, stretcher rib and ribholder runner notch arrangement combined with the upper and lower canopies.
Figure 7:
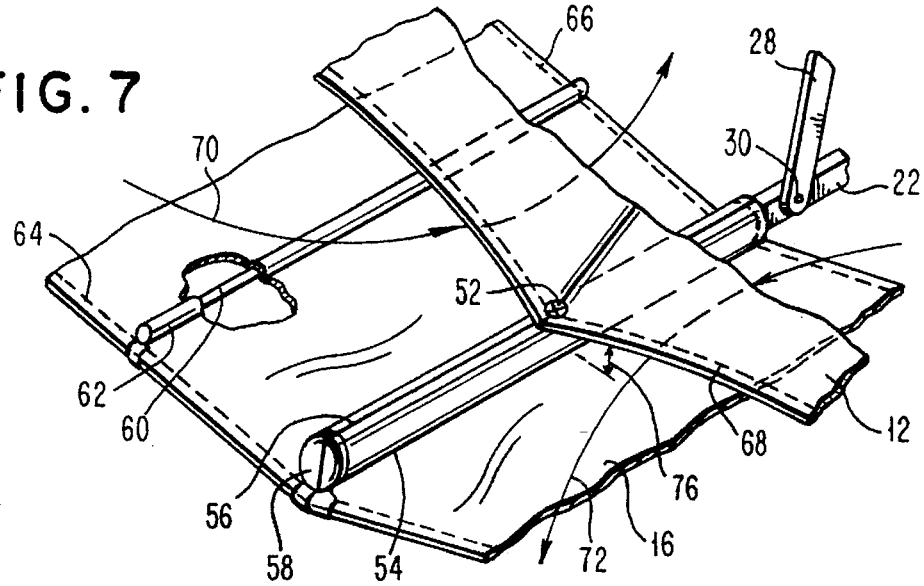
FIG. 7 is an exploded view of the section of the lower canopy and the end of the upper canopy as indicated by the broken lines "FIG. 7" in FIG. 1.
Figure 8:
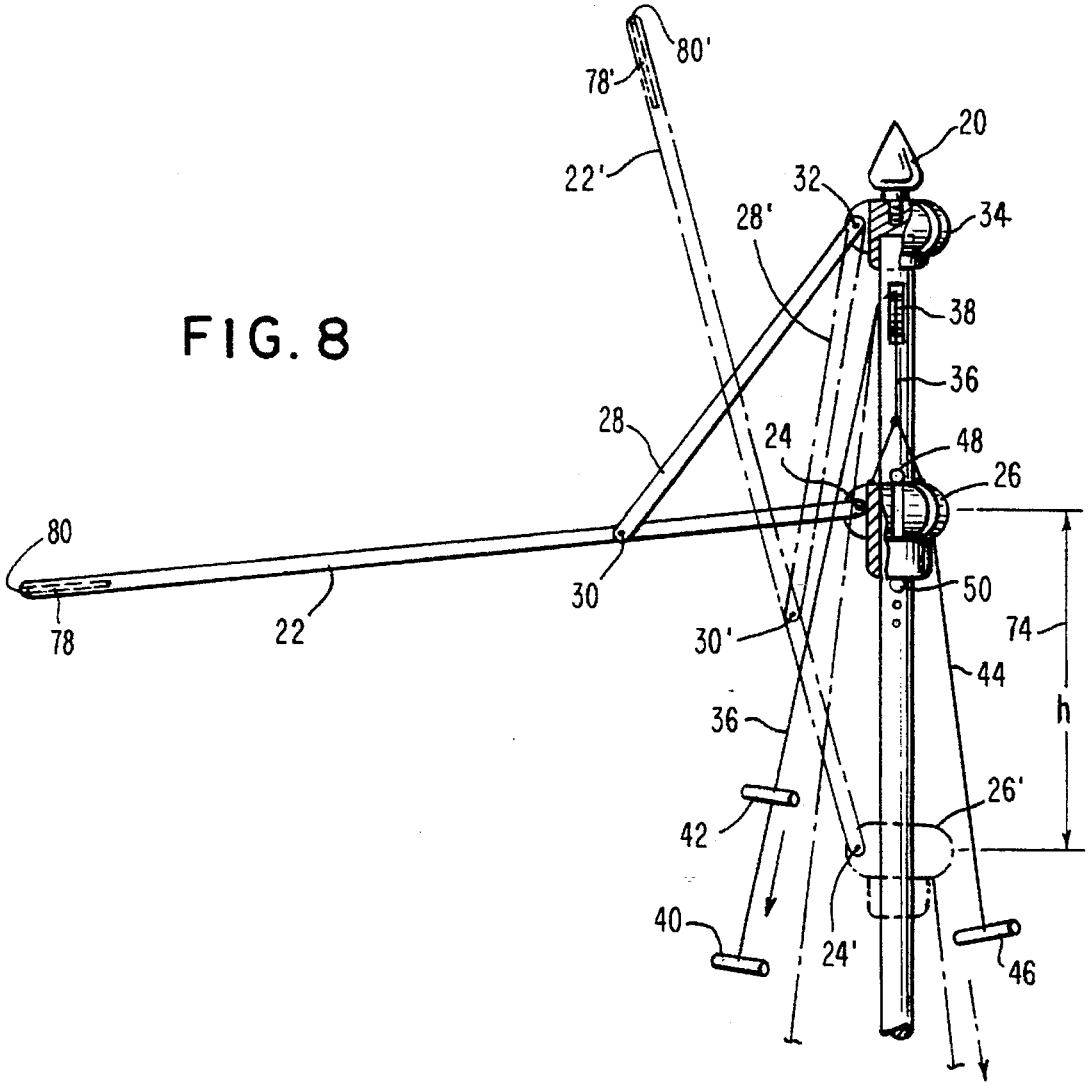
FIG. 8 shows a portion of the umbrella frame, with one canopy rib and stretcher rib pivotal connection to the ribholder runner notch and the umbrella top ribholder, depicted in both the open and closed umbrella positions.

The umbrella frame rib support system, shown more specifically in FIGS. 6, 7 and 8, includes long canopy ribs 22 pivotally connected at their inner ends by means of hinge pins 24 to a ribholder runner notch 26, while the other ends of canopy ribs 22 are received in long sleeves 18 sewn across the lower canopy 16 in a radial pattern for receiving a canopy rib 22 in each sleeve 18. A stretcher rib 28 is pivotally connected at one end by a pivot pin 30 to the canopy rib 22 and at its other end is pivotally connected by a pivot pin 32 to the top ribholder 34 fixedly secured at the top of the umbrella pole 20. The runner notch and ribholder 26, pivotally attached to canopy ribs 22, is adapted to slide vertically along the umbrella pole between the open position of the umbrella, shown in solid lines in FIG. 8, and the closed umbrella position, shown in broken lines with the frame and ribholder members indicated by primed numerals as canopy rib 22', stretcher rib 28', ribholder runner notch 26' and pivot pins 24' and 30'. The ribholder runner notch 26 travels a distance h, as shown in FIG. 8, between the open and closed positions of the umbrella. This distance h is determined by the design relationship between the length of the stretcher rib 28, the length of the segment of canopy rib 22 between its pivot pins 30 and 24, and the vertical stop position of the ribholder runner notch 26 on the pole 14, as set by an upper stop pin 48. The stretcher rib 28 is attached by pivot pin 30 to the canopy rib 22 at a point which is less than 50 percent out from the ribholder runner notch 26, preferably about 35 percent, of the total length of the rib 22.

Generally, the stretcher rib 28 has a length which extends to the canopy rib 22 at pivot pin 30 such that the canopy rib 22 is in open umbrella position with the canopy rib 22 tilted slightly downward from its ribholder end out to the canopy outer end. A counterweight 78, made of a metal, is securely held in a drill hole 80 formed at the outer end of each canopy rib 22. The counterweights 78, have a size, for example, of ⅜ inch diameter and a six inch length, and may weigh 2.5 ounces each. The counterweights 78 provide the weight determined to open and close the umbrella by raising and lowering the ribholder runner notch 26 with the desired amount of force. The counterweights 78 may be employed in all or only some of the ribs 22, such as in four of the eight ribs where only a portion of the full weight is desired to assist in opening the umbrella. The weight of the fabric of the outer canopy 16, the counterweights 78, and the length and weight of the canopy ribs 22 at the outer side of pivot pin 30 are internal factors considered when designing the external force required to raise the ribholder runner notch 26 to open the umbrella. In one example, where the full distance h of travel of the runner notch 26 between the fully open and the fully closed positions is 35 inches, where no counterweights are employed, the ribholder 26 must be raised 24 inches by external pulley cord forces from its lowest position at 26' before the internal weight forces, i.e. weight of the ribs 22 and lower canopy 16, take over to cause the ribholder 26 to continue up by its own forces, without any external forces, to the top position shown in FIG. 8 at which the umbrella is fully open. By contrast, when four counterweights, weighing 2½ ounces each, are mounted within the ends of four ribs 22, the ribholder 26 must be raised only 10 inches by external forces before the internal forces take over and raise the ribholder 26 the remaining distance to the 35 inch distance h. Further, where all eight counterweights, weighing 2½ ounces each, are mounted within eight rib ends, then the ribholder 26 must be raised only 6 inches by external forces before the internal forces take over and cause the ribholder 26 to be raised up to the fully open umbrella position.

In the present invention, the umbrella frame design employs a canopy rib 22 and stretcher rib 28 in "upside down" relationship with each other and with the ribholder runner notch 26, when compared with the known, widely used patio umbrella frames. According to the subject invention, the canopy ribs 22 are attached to the ribholder runner notch 26, as opposed to being attached to the fixed ribhilder 34 as in the conventional umbrellas. Also, in the subject invention, the stretcher ribs are pivoted between a pivot pin 30 point on the canopy rib 22 the fixed ribholder 34, as contrasted with the conventional umbrella wherein the stretcher rib is attached to the ribholder runner notch while a canopy rib extends from the fixed ribholder at the top of the pole, down to the end of the canopy. Also, it is noted that the lower canopy 16 is totally supported on the outer end of the canopy ribs 22, between the pivot pin 30 and the outer end of each rib 22, and produces a weight force which assists in opening the umbrella as an exterior upward force is provided on the ribholder runner notch 26.

The canopy design of the subject invention, incorporated into the canopy rib, stretcher rib and pivot arrangement, permits very easy opening and closing of the umbrella by movement of the runner notch between its upper, open umbrella position and its lower, closed umbrella position. A cord 36 is attached to the ribholder runner notch 25, as shown in FIGS. 6 and 8, and such cord extends up around a pulley 38 mounted in pole 14. The other end of cord 36 has an upper handle 42 and a lower handle 40 attached thereto. A downward pull force on either handle 40 or 42 will raise the ribholder runner notch 26 until it reaches its top position when it abuts with the stop pin 48 set in the pole 14. A second cord 44 with handle 46 is attached directly to the ribholder runner notch 26 to facilitate closing of the umbrella by a downward pull on the handle 46 and runner notch 26. Holes are provided in the pole 14, shown in FIGS. 6 and 8, for insertion of a lower stop pin 50, if desired, to lock the ribholder runner notch 26 in its upper, open umbrella position.

The lower canopy 16 comprises panels sewn together along the bottom of each canopy rib 16 along a stitch line 54, shown in FIG. 7 , and extending up to a seam 56 such that the canopy panel material forms the sleeve 18, shown in FIGS. 1 and 3 through 6, for receiving the canopy rib 16. The canopy material forms an end cap 58 at the end of the sleeve 18 against which the end of the canopy rib 22 will abut. The screw 52 extends through the bottow edge portion of the upper canopy 12, through the sleeve 18 and into the canopy rib 22, made of solid wood, and further secures the already tight fitting sleeve 18 to each rib 22. The canopies 12 and 16 are made of a strong support material, such as cotton, vinyl, acrylic, polyester, and synthetic stitch bonded fabrics that are supple and pliable in nature.

Each panel of the lower canopy 16 includes a metal rod 60 sewn therein in a sleeve 62 sewn from the canopy material at selected locations midway between the canopy rib sleeves 18. The metal rods 60 maintain the tight, stretched shape of the canopy and facilitate the handling of the canopy panels when closing the umbrella and wrapping the panels tightly together, as will be described below. Also, the lower canopy 16 is sewn along its inner edge by a hem or stitch 66, and along its outer edge by a hem or stitch 64. Similarly, a stitch 68 is sewn along the outer edge of the upper canopy 12. As shown in FIG. 7, a vent space, the height of which is indicated by the arrow 76, is formed by the gap formed between the upper canopy 12 and the lower canopy 16, and has a height about equal to the thickness of the rib 22. The vent space provides a passage for crosswinds, indicated by arrows 70, and for backdraft wind, indicated by arrows 72, and helps to stabilize the canopies and the umbrella from these winds.

Also, a strap 82 is attached by a snap connector 84 to the end tip of a canopy rib 22, as shown in FIG. 2. Strap 82 may, for example be made of a two inch wide, 72 inch long strong fabric material, with a male snap connector 86 affixed about one third from the top end snap 84, while a female snap connector 88 is affixed at the free end of the strap 82. When the umbrella is open, the strap 82 is within reach of the user. When the umbrella is to be folded, the strap 82 is snapped at 84 onto the end of the rib at the top of the umbrella and hangs down within reach of the user. The user encircles the umbrella canopy with the strap 82 in a downward circular manner, pulling all panels tightly together in a confined position, whereupon the snap 88 is snapped onto the snap 86. In this fashion, the umbrella remains fully and tightly secured, thereby preventing the panels from flapping, as well as preventing any substantial amounts of rain from entering the canopy flaps. Furthermore, the tight wrapping of the umbrella permits an umbrella cover to be conveniently and easily placed over the closed umbrella for complete protection and for a neat appearance.

While the invention has been described above with respect to its preferred embodiments, it should be understood that other forms and embodiments may be made without departing from the spirit and scope of the present invention.

What is claimed is:

1. In an umbrella having an umbrella pole, canopy means, rib means for supporting said canopy means and for opening and closing said umbrella, and a ribholder runner notch pivotally attached to said rib means and slidably engaged with said umbrella pole for moving up and down said umbrella pole for opening and closing said umbrella, the improvement of which comprises:

said rib means including canopy ribs, each canopy rib having a pivot end, a middle portion and a canopy end, each canopy rib being pivotally attached at its pivot end to said ribholder runner notch, and stretcher ribs, each of which is pivotally attached at one end to a top portion of said umbrella pole while the other end of each stretcher rib is pivotally connected to a respective canopy rib at a location between said pivot end and said canopy end on said canopy rib;

said canopy means including a lower outer canopy having a general ring shape that is open in its center and extending in a ring around an outer circumferential portion of the said umbrella, said lower outer canopy extending across and being supported on said middle portion and said canopy end of said canopy ribs, said canopy means also including an upper canopy extending from a top portion of said umbrella pole to said middle portion of said canopy ribs whereby said upper canopy covers a central portion while said lower outer canopy covers the outer circumferential portion of said umbrella; and said ribholder runner notch being adapted to be moved to an upper position on said umbrella pole and thereby pivot said canopy end of said canopy ribs, and said lower outer canopy, down to the open position of said umbrella, and said ribholder runner notch being adapted to be moved to a lower position on said umbrella pole and thereby pivot said canopy end of said canopy ribs, and said lower outer canopy, up to the closed position of said umbrella.

2. An umbrella as recited in claim 1, wherein said lower outer canopy includes sleeves extending radially across said lower outer canopy and attached thereto, each said sleeve adapted for receiving therein said rib canopy end and at least a portion of said middle portion of a respective canopy rib such that said rib canopy end extends to an outer end of said canopy sleeve.

3. An umbrella as recited in claim 2, wherein each said canopy rib has a top portion and a bottom portion extending along the length of said canopy rib and a predetermined height between said top portion and said bottom portion, said lower outer canopy extending across the bottom portion of said canopy ribs, and said upper canopy extending to said middle portion of said canopy ribs at said top portion of said canopy ribs whereby a wind vent space is formed between said lower outer canopy and said upper canopy having a height substantially equal to said predetermined height.

4. An umbrella as recited in claim 3, further comprising means for attaching said upper canopy to a plurality of said canopy ribs at said middle portion thereof.

5. An umbrella as recited in claim 2, wherein each said sleeve comprises a portion of said lower outer canopy sewn to form a canopy sleeve which extends radially across said lower outer canopy, and an end cap of said sleeve for engaging said canopy end of each said canopy rib.

6. An umbrella as recited in claim 1, further comprising metal rods secured in said lower outer canopy at selected locations for maintaining the tight condition of said lower outer canopy when the umbrella is open, and to facilitate handling of said lower outer canopy when the umbrella is closed.

7. An umbrella as recited in claim 6, wherein said metal rods are secured in said lower outer canopy in further canopy sleeves extending radially across said lower outer canopy and positioned substantially midway between adjacent sleeves for said canopy ribs.

8. An umbrella as recited in claim 1, further comprising stop means for fixing the said ribholder runner notch in its said upper position on said umbrella pole for which said umbrella is open.

9. An umbrella as recited in claim 8, wherein each said canopy rib is positioned with its canopy end in a lower horizontal position than the horizontal position of its pivot end when said ribholder runner notch is positioned in its upper position on said umbrella pole, and said canopy end is pivoted up above said ribholder runner notch when said ribholder runner notch is lowered to thereby close said umbrella.

10. An umbrella as recited in claim 1, further comprising cord pulley means attached to said ribholder runner notch for raising said ribholder runner notch from its lower position to its upper position, and cord means attached to said ribholder runner notch for lowering it to its lower position for closing said umbrella.

11. An umbrella as recited in claim 1, further comprising strap means adapted for attachment to said lower outer canopy when in the umbrella closed position, said strap means having sufficient length to wrap around said lower outer canopy and holding said canopy tightly closed.

12. An umbrella as recited in claim 11, wherein said strap means further includes attachment means for attaching said strap onto itself.

13. An umbrella as recited in claim 1, further comprising counterweights mounted in said canopy ends of said canopy ribs to provide a downward weight which acts to pivot said canopy rib about its pivot end and thereby facilitate opening of said umbrella.

14. An umbrella as recited in claim 13, wherein said counterweights comprise cylindrical metal rods, and said counterweights are mounted in said canopy ends of said canopy ribs in drill holes formed in said canopy ends.

15. An umbrella as recited in claim 1, wherein said lower outer canopy is secured to said canopy ribs by a canopy sleeve sewn to receive said canopy ribs such that it extends along the bottom side of said canopy ribs, and said upper canopy extends down to said top side of said canopy ribs and is attached thereto, thereby forming an air vent space between said lower outer canopy and said upper canopy.

16. In an umbrella having an umbrella pole, canopy means, rib means for supporting said canopy means and for opening and closing said umbrella, and a ribholder runner notch pivotally attached to said rib means and slidably engaged with said umbrella pole for moving up and down said umbrella pole for opening and closing said umbrella, the improvement of which comprises:

said rib means including canopy ribs, each canopy rib having a pivot end, a middle portion and a canopy end, each canopy rib being pivotally attached at its pivot end to said ribholder runner notch, and stretcher ribs, each of which is pivotally attached at one end to a top portion of said umbrella pole while the other end of each stretcher rib is pivotally connected to a respective canopy rib at a location between said pivot end and said canopy end on said canopy rib;

said canopy means including a lower outer canopy having a general ring shape that is open in its center and extending in a ring around an outer circumferential portion of the said umbrella, said lower outer canopy extending across and being supported on said middle portion and said canopy end of said canopy ribs, said lower outer canopy further including rib sleeves extending radially across said lower outer canopy and attached thereto, each said rib sleeve adapted for receiving therein one of said canopy rib ends and at least a portion of said middle portion of a respective canopy rib, such that said rib canopy end extends to an outer end of said canopy sleeve, said canopy means also including an upper canopy extending from the top portion of said umbrella pole to said middle portion of said canopy ribs whereby said upper canopy covers a central portion of said canopy ribs while said lower outer canopy covers the outer circumferential portion of said umbrella; and said ribholder runner notch being adapted to be moved to an upper position on said umbrella pole and thereby pivot said canopy end of said canopy ribs, and said lower outer canopy, down to the open position of said umbrella, and said ribholder runner notch being adapted to be moved to a lower position on said umbrella pole and thereby pivot said canopy end of said canopy ribs, and said lower outer canopy, up to the closed position of said umbrella.

17. In an umbrella having an umbrella pole, canopy means, rib means for supporting said canopy means and for opening and closing said umbrella, and a ribholder runner notch pivotally attached to said rib means and slidably engaged with said umbrella pole for moving up and down said umbrella pole for opening and closing said umbrella, the improvement of which comprises:

said rib means including canopy ribs, each canopy rib having a pivot end, a middle portion and a canopy end, each canopy rib being pivotally attached at its pivot end to said ribholder runner notch, each said canopy rib having a top longitudinal edge and a bottom longitudinal edge extending along the length of said canopy rib and defining a canopy rib thickness between said longitudinal edges, and stretcher ribs, each of which is pivotally attached at one end to a top portion of said umbrella pole while the other end of each stretcher rib is pivotally connected to a respective canopy rib at a location between said pivot end and said canopy end on said canopy rib;

said canopy means including a lower outer canopy having a general ring shape that is open in its center and extending in a ring around an outer circumferential portion of the said umbrella, said lower outer canopy extending across and being supported on said middle portion and said canopy end of said canopy ribs, said canopy means also including an upper canopy extending from a top portion of said umbrella pole to said middle portion of said canopy ribs whereby said upper canopy covers a central portion of said canopy ribs while said lower outer canopy covers the outer circumferential portion of said umbrella, said lower outer canopy extending across the bottom portion of said canopy ribs adjacent their said bottom longitudinal edges, and said upper canopy extending to said middle portion of said canopy ribs at their said top longitudinal edges whereby a wind vent space is formed between adjacent canopy ribs and between said lower outer canopy and said upper canopy having a height substantially equal to said canopy rib thickness; and said ribholder runner notch being adapted to be moved to an upper position on said umbrella pole and thereby pivot said canopy end of said canopy ribs, and said lower outer canopy, down to the open position of said umbrella, and said ribholder runner notch being adapted to be moved to a lower position on said umbrella pole and thereby pivot said canopy end of said canopy ribs, and said lower outer canopy, up to the closed position of said umbrella.

18. In an umbrella having an umbrella pole, canopy means, rib means for supporting sale canopy means and for opening and closing said umbrella, and a ribholder runner notch pivotally attached to said rib means and slidably engaged with said umbrella pole for moving up and down said umbrella pole for opening and closing said umbrella, the improvement of which comprises:

said rib means including canopy ribs, each canopy rib having a pivot end, a middle portion and a canopy end, each canopy rib being pivotally attached at its pivot end to said ribholder runner notch, and stretcher ribs, each of which is pivotally attached at one end to a top portion of said umbrella pole while the other end of each stretcher rib is pivotally connected to a respective canopy rib at a location between said pivot end and said canopy end on said canopy rib;

counterweights mounted in said canopy ends of said canopy ribs to provide a downward weight which acts to pivot said canopy ribs about their pivot ends and thereby facilitate opening of said umbrella;

said canopy means including a lower outer canopy having a general ring shape that is open in its center and extending in a ring around an outer circumferential portion of the said umbrella, said lower outer canopy extending across and being supported on said middle portion and said canopy end of said canopy ribs, said canopy means also including an upper canopy extending from a top portion of said umbrella pole to said middle portion of said canopy ribs whereby said upper canopy covers a central portion of said canopy ribs while said lower outer canopy covers the outer circumferential portion of said umbrella; and said ribholder runner notch being adapted to be moved to an upper position on said umbrella pole and thereby pivot said canopy end of said canopy ribs, and said lower outer canopy, down to the open position of said umbrella, and said ribholder runner notch being adapted to be moved to a lower position on said umbrella pole and thereby pivot said canopy end of said canopy ribs, and said lower outer canopy, up to the closed position of said umbrella.

* * * * *